US007790233B2

(12) United States Patent
Andolfatto et al.

(10) Patent No.: US 7,790,233 B2
(45) Date of Patent: Sep. 7, 2010

(54) METHOD FOR THE FORMATION OF A COATING OF METAL OXIDES ON AN ELECTRICALLY-CONDUCTIVE SUBSTRATE, RESULTANT ACTIVATED CATHODE AND USE THEREOF FOR THE ELECTROLYSIS OF AQUEOUS SOLUTIONS OF ALKALINE METAL CHLORIDES

(75) Inventors: Francoise Andolfatto, Vaulx-en-Velin (FR); Philippe Joubert, La Demi-Lune (FR); Gerard Duboeuf, Irigny (FR)

(73) Assignee: Arkema France, Colombes (FR)

( * ) Notice: Subject to any disclaimer, the term of this patent is extended or adjusted under 35 U.S.C. 154(b) by 1077 days.

(21) Appl. No.: 10/550,646

(22) PCT Filed: Mar. 25, 2004

(86) PCT No.: PCT/FR2004/000746

§ 371 (c)(1),
(2), (4) Date: Jun. 28, 2006

(87) PCT Pub. No.: WO2004/087992

PCT Pub. Date: Oct. 14, 2004

(65) Prior Publication Data

US 2006/0263614 A1 Nov. 23, 2006

(30) Foreign Application Priority Data

Mar. 28, 2003 (FR) ..... 03 03867

(51) Int. Cl.
*B05D 3/02* (2006.01)

(52) U.S. Cl. ..... 427/376.2; 427/376.4; 427/376.6; 427/379

(58) Field of Classification Search ..... 427/376.2, 427/376.4, 376.6, 379
See application file for complete search history.

(56) References Cited

U.S. PATENT DOCUMENTS

| | | | | |
|---|---|---|---|---|
| 3,850,668 | A * | 11/1974 | Heffer | 428/408 |
| 4,100,049 | A | 7/1978 | Brannan | |
| 5,864,051 | A * | 1/1999 | Iwasawa et al. | 568/479 |
| 6,132,653 | A * | 10/2000 | Hunt et al. | 264/5 |
| 6,527,924 | B1 | 3/2003 | Andolfatto et al. | |
| 6,576,302 | B1 | 6/2003 | Mizuta et al. | |
| 2004/0077494 | A1 * | 4/2004 | LaBarge et al. | 502/303 |
| 2007/0184208 | A1 * | 8/2007 | Sharma et al. | 427/532 |

FOREIGN PATENT DOCUMENTS

| | | |
|---|---|---|
| EP | 0 209 427 | 6/1986 |
| FR | 2311108 | 5/1976 |

* cited by examiner

*Primary Examiner*—Binh X Tran
(74) *Attorney, Agent, or Firm*—Steven D. Boyd

(57) ABSTRACT

The invention relates to a process for the formation of a coating of metal oxides comprising at least one precious metal from Group VIII of the Periodic Table of the elements, optionally in combination with titanium and/or zirconium, on an electrically conductive substrate made of steel or of iron, which consists in applying a sole solution of acetylacetonate (s) of the said metal(s) dissolved in a (plurality of) solvent(s) which specifically dissolve(s) each metal acetylacetonate; and in then drying and calcining the coated substrate. The invention also relates to an activated cathode obtained from the electrically conductive substrate coated with metal oxides and to its use in the electrolysis of aqueous solutions of alkali metal chlorides.

14 Claims, 2 Drawing Sheets

METHOD FOR THE FORMATION OF A COATING OF METAL OXIDES ON AN ELECTRICALLY-CONDUCTIVE SUBSTRATE, RESULTANT ACTIVATED CATHODE AND USE THEREOF FOR THE ELECTROLYSIS OF AQUEOUS SOLUTIONS OF ALKALINE METAL CHLORIDES

FIELD OF THE INVENTION

The invention relates to a process for the formation of a coating of metal oxides comprising at least one precious metal from Group VIII of the Periodic Table of the elements, optionally in combination with titanium and/or zirconium, on an electrically conductive substrate.

The invention also relates to an activated cathode obtained from the electrically conductive substrate coated according to the process of the invention.

The invention also relates to the use of the said activated cathode, in particular in the electrolysis of aqueous solutions of alkali metal chlorides and particularly in the preparation of chlorine and of sodium hydroxide and in the preparation of sodium chlorate.

BACKGROUND OF THE INVENTION

Thus, industrially, chlorine and sodium hydroxide, and sodium chlorate, are manufactured in electrolytic cells, each of them comprising several steel cathodes and several titanium anodes coated with a mixture of titanium and ruthenium oxides. As regards the preparation of chlorine and sodium hydroxide, the cells are generally fed with an electrolytic solution comprising approximately 200 to 300 g/l of sodium they generally comprise 50 to 250 g/l of sodium chloride.

However, these steel cathodes exhibit a relatively high overpotential in absolute value as cathodes for the reduction of water and also have an inadequate resistance to corrosion by dissolved chlorine.

The term "overpotential" is understood to mean the difference between the thermodynamic potential of the redox couple concerned ($H_2O/H_2$) with respect to a reference cathode and the potential actually measured in the medium concerned, with respect to the same reference electrode. The term "overpotential" will conventionally be used to denote the absolute value of the cathode overpotential.

Numerous cathodes have been proposed in order to overcome these disadvantages.

Thus, French Patent Application FR 2 311 108 discloses a cathode for which the substrate is a plate made of titanium, of zirconium, of niobium or of an alloy essentially composed of a combination of these metals and to which substrate a layer of metal oxide, essentially composed of an oxide of one or more metals chosen from ruthenium, rhodium, palladium, osmium, iridium and platinum and optionally an oxide of one or more metals chosen from calcium, magnesium, strontium, barium, zinc, chromium, molybdenum, tungsten, selenium and tellurium, is applied.

U.S. Pat. No. 4,100,049 discloses a cathode comprising a substrate made of iron, nickel or cobalt or of an alloy of these metals and a coating of palladium oxide and zirconium oxide.

European Patent Application EP 209 427 provides a cathode composed of an electrically conductive substrate made of nickel, of stainless steel or of mild steel carrying a coating composed of a plurality of layers of metal oxides, the surface layer being composed of an oxide of a valve metal, that is to say a metal chosen from Groups IVb, Vb and VIb of the Periodic Table of the elements, and the intermediate layer being composed of an oxide of a precious metal from Group VIII, that is to say ruthenium, rhodium, palladium, osmium, iridium and platinum.

The intermediate and surface layers can be composed of the oxide of the only metal concerned or of a mixed oxide of the metal concerned and of the second metal in a low proportion.

In Patent Application FR 2 797 646, the Applicant Company has provided an activated cathode composed of an electrically conductive substrate, either made of titanium or of nickel, coated with an intermediate layer of oxides based on titanium and on a precious metal from Group VIII of the Periodic Table of the elements and with an external layer of metal oxides comprising titanium, zirconium and a precious metal from Group VIII of the Periodic Table of the elements; the said coating being obtained by thermal decomposition of a solution of chloride or of oxychloride of these metals in ethanol or isopropanol.

Out of a concern for economy, it is increasingly desired to use cheaper substrates, such as substrates made of steel or of iron.

SUMMARY OF THE INVENTION

However, the Inventors has found that the method mentioned above does not make it possible to obtain a coating which adheres to an electrically conductive substrate made of steel or of iron.

The Inventors has found that, by carefully choosing organometallic compounds and their solvents, it obtains coatings of the abovementioned metal oxides which exhibit very good adhesion to substrates made of steel or of iron.

DETAILED DESCRIPTION OF THE INVENTION

Figure 1:
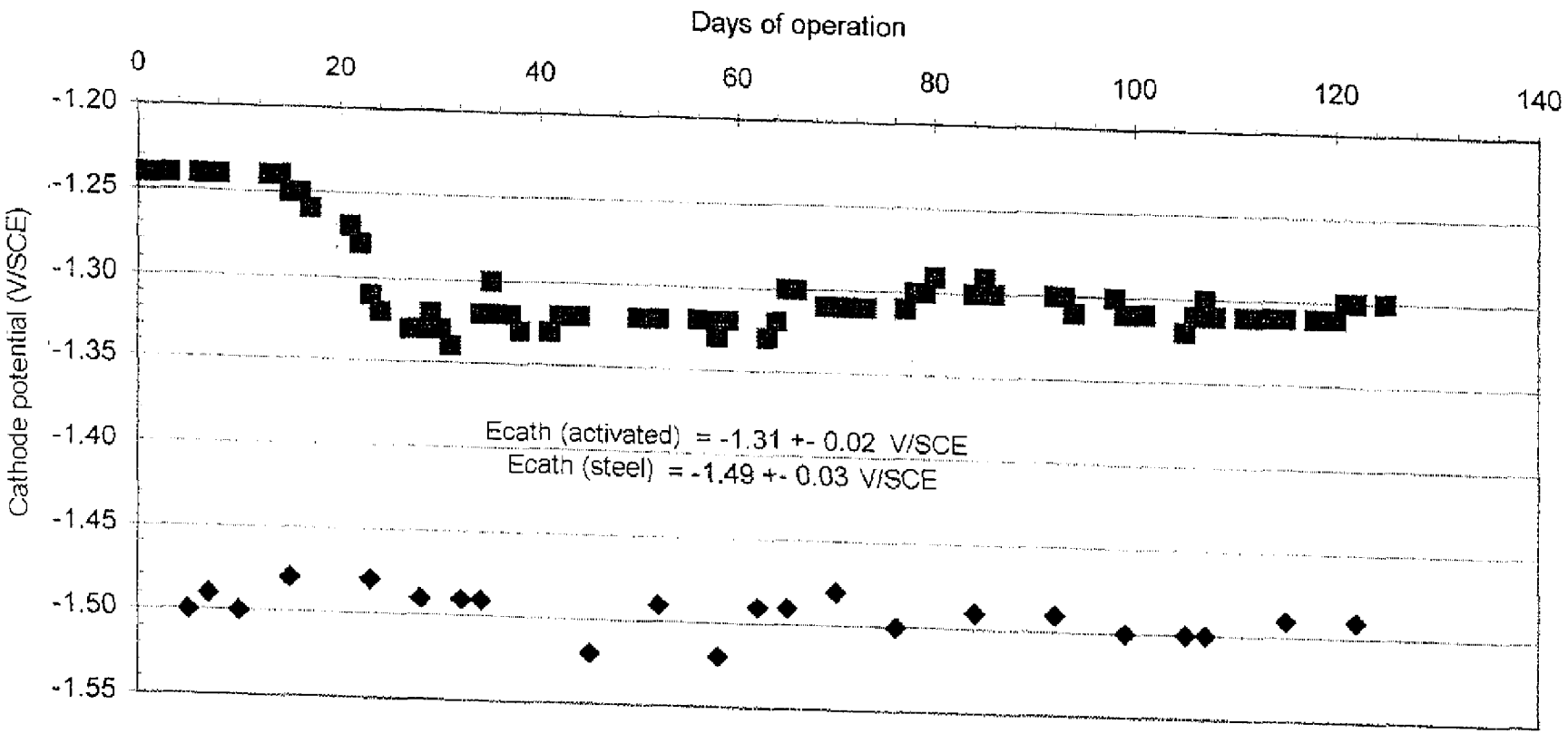
FIG. 1 is a graph of cathode potential verses days of operation.

A subject-matter of the invention is therefore a process for the formation of a coating of metal oxides comprising at least one precious metal from Group VIII of the Periodic Table of the elements, optionally in combination with titanium and/or zirconium, on an electrically conductive substrate; the said process consisting in applying, to the said substrate, a solution comprising at least one organometallic compound and in then converting the said organometallic compound(s) to metal oxide(s) by means of a heat treatment; the said process being characterized in that the electrically conductive substrate is made of steel or of iron and in that the sole solution applied to the said substrate is a non-aqueous solution of metal acetylacetonate or of a mixture of metal acetylacetonates dissolved in a (plurality of) solvent(s) which specifically dissolve(s) each metal acetylacetonate, the solvent(s) being chosen from alcohols, ketones, chloromethanes or a mixture of two or more solvents mentioned above.

According to the present invention, the term "precious metal from Group VIII of the Periodic Table of the elements" is understood in this context to mean ruthenium, rhodium, palladium, osmium, iridium or platinum. Use will preferably be made of ruthenium or iridium and very particularly of ruthenium.

Mention will be made, by way of illustration of alcohols which can be used according to the present invention, of ethanol or isopropanol.

Mention will be made, by way of illustration of ketones which can be used according to the present invention, of acetone or methyl ethyl ketone.

Mention will be made, by way of illustration of chloromethanes which can be used according to the present invention, of methylene chloride or chloroform.

According to the present invention, the solution which is applied to the electrically conductive substrate is a solution of an acetylacetonate of a metal chosen from the group: Ru, Rh, Pd, Os, Ir, Pt, Ti and Zr, or a mixture of acetylacetonates of two or more of the metals taken from this group.

A number of scenarios are possible in preparing the solution of metal acetylacetonate(s) used to coat the electrically conductive substrate according to the process of the invention.

If the said solution comprises only one metal acetylacetonate, it can be obtained by dissolution of this metal acetylacetonate in its specific solvent or in a mixture of solvents comprising the specific solvent.

If the said solution comprises several metal acetylacetonates, it can be obtained:

- either by dissolution of the said metal acetylacetonates in a mixture of solvents comprising the specific solvents for the said metal acetylacetonates;
- or by mixing solutions comprising only a single metal acetylacetonate which are obtained by dissolution of the said metal acetylacetonate in a specific solvent or in a mixture of solvents comprising the specific solvent for the said acetylacetonate.

The solution can advantageously be prepared with stirring at ambient temperature, indeed even at a slightly higher temperature in order to improve the dissolution of the metal acetylacetonates.

According to the present invention, use will preferably be made of concentrated solutions of metal acetylacetonates and, in order to prepare the said solutions, it is the responsibility of a person skilled in the art to take into account the solubility of the various metal acetylacetonates in the solvents (or mixture of solvents) which can be used according to the present invention.

For example, use will be made, at ambient temperature, of a 0.25 mol/litre ethanol solution of ruthenium acetylacetonate ($(C_5H_7O_2)_3Ru$) and of a 0.8 mol/litre acetone solution of titanyl acetylacetonate ($(C_5H_7O_2)_2TiO$).

A preferred method for the formation of a coating of metal oxides according to the present invention consists, in a first stage, in pretreating the substrate made of steel or of iron, in order to confer thereon characteristics of surface roughness, and then, in a second stage, in depositing, on the said pretreated substrate, the solution comprising the metal acetylacetonate(s), which is prepared as indicated above, and then in drying and calcining the substrate thus coated.

This second stage (impregnation/drying/calcination) can advantageously be repeated one or more times in order to obtain the coating. Preferably, this second stage is repeated until the desired weight of metal is obtained. Generally, this stage is repeated between 2 and 6 times.

The pretreatment generally consists of subjecting the substrate either to sandblasting, optionally followed by washing with acid, or to pickling using an aqueous solution of oxalic acid, of hydrofluoric acid, of a mixture of hydrofluoric acid and of nitric acid, of a mixture of hydrofluoric acid and of glycerol, of a mixture of hydrofluoric acid, of nitric acid and of glycerol or of a mixture of hydrofluoric acid, of nitric acid and of hydrogen peroxide, followed by one or more washing operation(s) with degasified demineralized water.

The substrate can be in the form of a solid plate, perforated plate, expanded metal or basket cathode formed from the expanded or perforated metal.

The solution can be deposited on the pretreated substrate using various techniques, such as sol-gel, spraying or coating. Advantageously, the pretreated substrate is coated with the solution, for example using a brush. The substrate, thus coated, is subsequently dried in the air and/or in an oven at a temperature at most equal to 150° C. After drying, the substrate is calcined under air or else under an inert gas enriched with oxygen, at a temperature at least equal to 300° C. and preferably of between 400° C. and 600° C., for a period of time ranging from 10 minutes to 2 hours.

Operating in this way makes it possible to convert the metal acetylacetonate(s) to a uniform and adherent coating of metal oxide(s) on the substrate made of steel or of iron.

The solution can be deposited just as easily on one of the faces of a pretreated substrate as on both faces.

The weights of precious metal deposited, expressed in $g/m^2$ with respect to the geometrical surface of the substrate, is at least equal to 2 $g/m^2$, generally between 2 and 20 $g/m^2$ and preferably between 5 and 10 $g/m^2$.

Another subject-matter of the invention is an "activated" cathode obtained from an electrically conductive substrate coated according to the invention.

The cathode of the present invention is very particularly suitable for the electrolysis of aqueous solutions of alkali metal chlorides and in particular of aqueous NaCl solutions.

The use of the cathode of the present invention in combination with an anode makes it possible to electrolytically synthesize chlorine and the hydroxide of an alkali metal.

The use of the cathode of the present invention in combination with an anode makes it possible to electrolytically synthesize the chlorate of an alkali metal.

Mention may be made, as anode, of DSA (Dimensionally Stable Anode) anodes composed of a substrate made of titanium coated with a layer of titanium and ruthenium oxides. The ruthenium/titanium molar ratio in this layer is advantageously between 0.4 and 2.4.

The cathode of the present invention possesses the advantage of having a low overpotential and of being formed from a cheap substrate.

The examples which follow illustrate the invention.

EXAMPLE 1

Coating Based on Ru, Ti and Zr Oxides

The coating solution was prepared by dissolution of 0.653 g of ruthenium acetylacetonate, 0.329 g of titanyl acetylacetonate and 0.178 g of zirconium acetylacetonate in 10 ml of ethanol+10 ml of acetone+10 ml of chloroform, in order to obtain a molar distribution 45 Ru/45 Ti/10 Zr.

The support is composed of a solid plate made of iron (3.5×2.5 cm), to which is welded a steel rod; the total surface area is 33 $cm^2$. The support is sandblasted beforehand with corundum and then rinsed with acetone.

The support is subsequently coated in its entirety with the solution and is placed in an oven at 120° C. for 15 minutes and then in an oven at 450° C. for 15 minutes. A coating of 2.4 $g/m^2$ is thus obtained. This procedure is repeated 3 times (4 layers in total), so as to obtain a coating having a weight of 7.9 $g/m^2$, i.e. an equivalent weight of 3.3 g $Ru/m^2$. The final heat treatment of the support is 30 minutes at 450° C.

Before the electrochemical evaluation, the steel rod is masked with Teflon tape in order to mark off a well-defined area. The coated support is subsequently placed in an electrochemical cell containing 200 ml of 1 M sodium hydroxide solution, at ambient temperature, and will be tested as a cathode. A counterelectrode composed of a titanium anode coated with $RuO_2$—$TiO_2$ and a saturated calomel reference electrode (SCE), extended by a capillary containing a saturated KCl solution, are used. The electrodes are connected to the terminals of a potentiostat (Solartron). The activity of the cathode is measured from the polarization curves (from the rest potential up to −1.3 or −1.4 V/SCE, at a rate of 1 mV/S). An activation stage is subsequently carried out by applying a current with an intensity of 2 amperes to the cathode for 1 hour, and a new polarization curve is subsequently plotted in order to evaluate the alterations in the electrochemical performance of the cathode. This activation stage is repeated until a stable polarization curve, that is to say identical to the curve preceding the final activation, is obtained (generally 3 or 4 times).

The change in the cathode potential for a current density of 1.6 kA/m$^2$ as a function of the number of activation stages is presented in Table 1 below. The less negative the potential and the lower the over-potential for reduction of water, which means the greater the activation of the cathode. At the same time, the same characterization procedures are applied to a support of identical shape and identical nature but free from any deposit. The increase in voltage is the difference between the potential of the activated cathode and the potential of the cathode made of bare iron for the same current density (in this instance, 1.6 kA/m$^2$)

TABLE 1

| | $E_{cath}$ at 1.6 kA/m$^2$ (V/SCE) | Increase in voltage with respect to an iron support (V) |
|---|---|---|
| 1st Polarization | −1.34 | 0.06 |
| 2nd Polarization | −1.25 | 0.15 |
| 3rd Polarization | −1.24 | 0.16 |

EXAMPLE 2

Coating Based on Ru and Ti Oxides

The solution is prepared by dissolution at 0.500 g of ruthenium acetylacetonate and 0.329 g of titanyl acetylacetonate in 10 ml of ethanol+10 ml of acetone, so as to obtain an equimolar Ru/Ti solution.

The support is composed of a solid plate made of iron (3.5×2.5 cm), to which is welded a steel rod; the total surface area is 33 cm$^2$. The support is sandblasted beforehand with corundum and then rinsed with acetone.

The support is subsequently coated in its entirety with the solution and is placed in an oven at 120° C. for 15 minutes and then in an oven at 450° C. for 15 minutes. A coating of 2.2 g/m$^2$ is thus obtained. This procedure is repeated 3 times (4 layers in total), so as to obtain a coating having a weight of 9.8 g/m$^2$, i.e. an equivalent weight of 4.6 g Ru/m$^2$. The final heat treatment is 30 minutes at 450° C.

The electrochemical characterization of this element is carried out under the same conditions as those described in Example 1. The change in the potential of the cathode and in the increase in voltage by comparison with a cathode made of bare iron are presented in Table 2 below.

TABLE 2

| | $E_{cath}$ at 1.6 kA/m$^2$ (V/SCE) | Increase in voltage with respect to an iron support (V) |
|---|---|---|
| 1st Polarization | −1.34 | 0.06 |
| 2nd Polarization | −1.24 | 0.16 |
| 3rd Polarization | −1.23 | 0.17 |

More than 25 activated cathodes having an equimolar coating of Ru and Ti were prepared under conditions similar to these, on solid supports made of iron or of steel or on expanded supports made of iron or of steel, and were characterized according to the procedure described in Example 1. The mean increase in voltage observed by comparison with an uncoated cathode of the same shape and of the same nature is 160±20 mV.

EXAMPLE 3

100% Ru Oxide Coating

The solution is prepared by dissolution of 0.500 g of ruthenium acetylacetonate in 10 ml of ethanol+10 ml of acetone.

The support is composed of a solid plate made of iron (3.5×2.5 cm), to which is welded a steel rod; the total surface area is 33 cm$^2$. The support is sandblasted beforehand with corundum and then rinsed with acetone.

The support is subsequently coated in its entirety with the solution and is placed in an oven at 120° C. for 15 minutes and then in an oven at 450° C. for 15 minutes. A coating of 1.9 g/m$^2$ is thus obtained. This procedure is repeated 2 times (3 layers in total), so as to obtain a coating having a weight of 3.8 g/m$^2$, i.e. an equivalent weight of 2.9 g Ru/m$^2$. The final heat treatment is 30 minutes at 450° C.

The electrochemical characterization of the element is carried out under the same conditions as those described in Example 1. The change in the potential of the cathode and in the increase in voltage by comparison with a cathode made of bare iron are presented in Table 3 below.

TABLE 3

| | $E_{cath}$ at 1.6 kA/m$^2$ (V/SCE) | Increase in voltage with respect to an iron support (V) |
|---|---|---|
| 1st Polarization | −1.24 | 0.16 |
| 2nd Polarization | −1.18 | 0.22 |
| 3rd Polarization | −1.17 | 0.23 |

EXAMPLE 4

100% Ru Oxide Coating

The solution is prepared by dissolution of 0.500 g of ruthenium acetylacetonate in 10 ml of ethanol.

The support is composed of a solid plate made of steel (3.5×2.5 cm), to which is welded a steel rod; the total surface area is 33 cm$^2$. The support is sandblasted beforehand with corundum and then rinsed with acetone.

The support is subsequently coated in its entirety with the solution and is placed in an oven at 120° C. for 15 minutes and then in an oven at 450° C. for 15 minutes. A coating of 2.1 g/m$^2$ is thus obtained. This procedure is repeated 3 times (4 layers in total), so as to obtain a coating having a weight of 7.6 g/m$^2$, i.e. an equivalent weight of 5.8 g Ru/m$^2$. The final heat treatment is 30 minutes at 450° C.

The electrochemical characterization of the element is carried out under the same conditions as those described in Example 1. The change in the potential of the cathode and in the increase in voltage by comparison with a cathode made of bare steel are presented in Table 4 below.

TABLE 4

| | $E_{cath}$ at 1.6 kA/m$^2$ (V/SCE) | Increase in voltage with respect to a steel support (V) |
|---|---|---|
| 1st Polarization | −1.28 | 0.12 |
| 2nd Polarization | −1.20 | 0.20 |
| 3rd Polarization | −1.18 | 0.22 |

More than 25 activated cathodes having a 100% $RuO_2$ coating were prepared under conditions similar to those described in Examples 3 and 4, on solid supports made of iron or of steel or on expanded supports made of iron or of steel, and were characterized according to the procedure described in Example 1. The mean increase in voltage observed by comparison with a cathode of the same shape and of the same nature but uncoated is 200±50 mV.

EXAMPLE 5

Cathode for a Diaphragm Chlorine-Sodium Hydroxide Electrolysis Pilot-Scale Device An activated cathode of 72 cm$^2$ is prepared for a diaphragm chlorine-sodium hydroxide electrolysis laboratory pilot-scale device. The substrate is composed of a grid made of steel used on industrial cells. The desired coating is of equimolar Ru and Ti composition, it is prepared according to the procedure described in Example 2 and it is deposited on both faces of the support material. The weight of coating is 13.7 g/m$^2$, i.e. 6.5 g Ru/m$^2$, deposited in 4 layers. Because of its size, no electrochemical characterization is carried out on this cathode before it is installed on the pilot-scale cell.

The activated cathode is installed in a diaphragm chlorine-sodium hydroxide electrolysis pilot-scale cell which uses a Polyramix® diaphragm and which operates continuously 24 hours a day, 7 days a week. Interplay between withdrawing and feeding makes it possible to keep constant the concentration of the various products in the electrolysis cell. The operating conditions are as follows: 2.5 kA/m$^2$, 85° C., sodium hydroxide concentration in the cathode liquor between 120 g/l and 140 g/l, anode made of expanded titanium coated with $RuO_2$—$TiO_2$. A cathode made of uncoated iron resulting from the same industrial support is installed in an equivalent cell operating under the same operating conditions. The change in the potential of these two cathodes over an operating time of 120 days is presented in FIG. 1.

In this graph: ■ denotes activated cathode and ♦ denotes bare steel cathode.

The increase in voltage, obtained by difference in the two potentials, is of the order of 180 mV over the operating period 20 days-120 days.

EXAMPLE 6

Use of an Activated Cathode in Sodium Chlorate Electrolysis

An activated cathode of 200 cm$^2$ (5×40 cm) for a sodium chlorate electrolysis pilot-scale device is prepared. A support made of iron is coated on both its faces with an equimolar coating of Ru and Ti according to the procedure described in Example 2, except that the final heat treatment is 1 hour at 450° C. The weight of coating is 10.3 g/m$^2$, i.e. 4.9 g Ru/m$^2$. This cathode is subsequently placed in a sodium chlorate electrolysis pilot-scale cell. The anode is composed of a support made of expanded titanium coated with $RuO_2$—$TiO_2$. The operating conditions of the sodium chlorate electrolysis cell are as follows: [NaCl]=200 g/l, [$NaClO_3$]=300 g/l, [$Na_2Cr_2O_7.2H_2O$]=4 g/l, T=80° C., anode-cathode distance=3 mm, current density=4 kA/m$^2$, continuous operation 24 hours a day, 7 days a week. Interplay between withdrawing and feeding makes it possible to keep constant the concentration of the different products in the electrolysis cell.

At the same time as this test, a similar cell operates under the same operating conditions with a cathode of the same shape made of uncoated iron.

These two cells have operated for more than 500 consecutive hours and the cell voltage is measured approximately every 50 hours. For the duration of the test, the voltage of the cell using the activated cathode is 200±50 mV lower than the voltage of the cell using a cathode made of uncoated iron.

EXAMPLE 7

Comparative Example

Influence of the Nature of the Substrate

Figure 2:
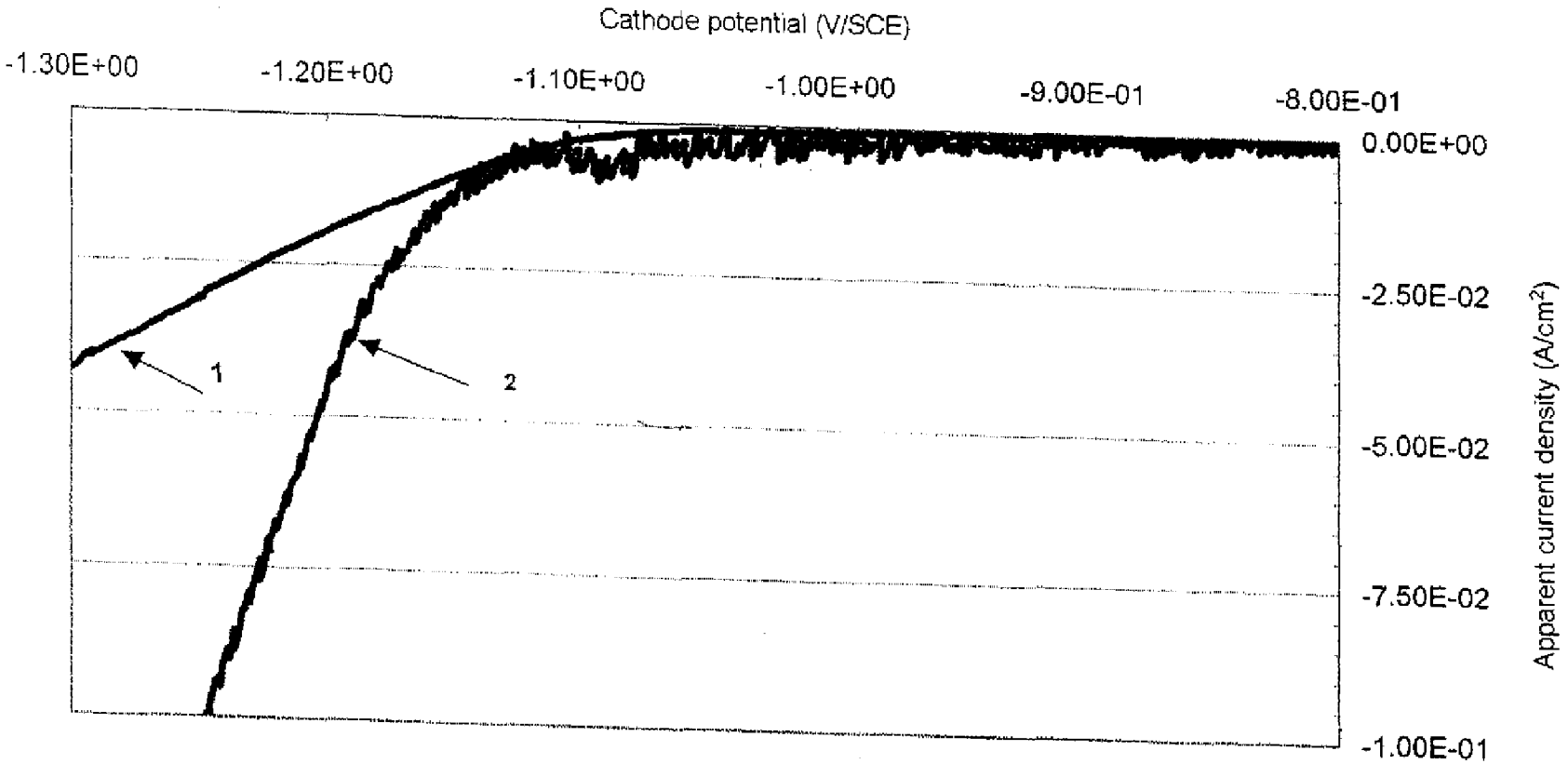
FIG. 2 is polarization curves.

A substrate composed of a solid plate of nickel and a substrate composed of a solid plate or iron are coated with an equimolar $RuO_2$—$TiO_2$ coating according to the procedure described in Example 2, the "coating/drying/calcination" cycle being repeated until a coating of 9-10 g/m$^2$, i.e. 4.3 to 4.7 g Ru/m$^2$, is obtained. The final heat treatment is 30 minutes at 450° C. Three layers are necessary for the support made of iron and 6 layers for the support made of nickel: the coating is less adherent to nickel than to iron; these cathodes are subsequently evaluated electrochemically according to the procedure described in Example 1. The polarization curves after stabilization of each of these cathodes are presented in FIG. 2. It is found that the coated cathode with a nickel substrate (curve 1) exhibits a poorer performance that then coated cathode with an iron substrate (curve 2): for the same current density, the potential of the activated cathode with a nickel support is more negative than the potential of the activated cathode with an iron support.

EXAMPLE 8

Example not in Accordance with the Invention

Deposition of an $RuO_2$—$TiO_2$ Coating on a Support made of Iron and on a Support made of Nickel from a Solution Comprising a Ruthenium Chloride and a Titanium Oxychloride An equimolar Ru/Ti coating solution is prepared by dissolution of 5.18 g of $RuCl_3.1.5H_2O$ and of 3.1 ml of $TiOCl_2.2HCl$ (124.5 g Ti/l) in 10 ml of absolute ethanol. The solution is stirred to allow the products to dissolve.

A first support is composed of a solid plate of iron (3.5×2.5 cm), to which is welded a steel rod; the total surface area is 33 cm$^2$. The support is sandblasted beforehand with corundum and then rinsed with acetone.

A second support is composed of a solid plate made of nickel (3.5×2.5 cm), to which is welded a nickel rod; the total surface area is 33 cm$^2$. The support is sandblasted beforehand with corundum and then rinsed with acetone.

Each support is subsequently coated in its entirety with the solution and placed in an oven at 120° C. for 15 minutes and then in an oven at 450° C. for 15 minutes. The final heat treatment is 30 minutes at 450° C.

The change in the weight of the coating as a function of the number of "coating/drying/calcination" cycles for each of the two supports is presented in the following Table 5.

TABLE 5

| | Iron Support | Nickel Support |
|---|---|---|
| 1st Layer | 14.1 g/m$^2$ | 6.2 g/m$^2$ |
| 2nd Layer | 25.8 g/m$^2$ | 12.4 g/m$^2$ |
| 3rd Layer | | 18.5 g/m$^2$ |
| 4th Layer | | 21.2 g/m$^2$ |
| Colour of the coating | Brown | Black |

The electrochemical characterization of the electrodes is carried out under the same conditions as those described in Example 1. The change in the potential of the cathode with an iron support and in the increase in voltage, by comparison with a cathode made of bare iron (Table 6), and in the potential of the cathode with a nickel support and in the increase in voltage, by comparison with a cathode made of bare iron (Table 7), are presented in Tables 6 and 7 below.

TABLE 6

| Cathode with an iron support | $E_{cath}$ at 1.6 kA/m$^2$ (V/SCE) | Increase in voltage with respect to a bare iron support (V) |
|---|---|---|
| 1st Polarization | −1.35 | 0.05 |
| 2nd Polarization | −1.40 | 0 |

The coating of the cathode with an iron support falls off with strong evolution of gas and the performance obtained subsequently is that of a cathode made of uncoated iron. The colour of the coating after the final heat treatment indicates the significant presence of iron oxide.

TABLE 7

| Cathode with a nickel support | $E_{cath}$ at 1.6 kA/m$^2$ (V/SCE) | Increase in voltage with respect to a bare iron support (V) |
|---|---|---|
| 1st Polarization | −1.3 | 0.10 |
| 2nd Polarization | −1.17 | 0.23 |
| 3rd Polarization | −1.15 | 0.25 |

No deterioration in the cathode with a nickel support is observed after the various stages of electrochemical characterization and the increase in voltage by comparison with a cathode made of bare iron is improved by the electrochemical characterization.

The invention claimed is:

1. Process for the formation of a coating of metal oxides comprising at least one precious metal from Group VIII of the Periodic Table of the elements in combination with titanium, zirconium or mixtures thereof, on an electrically conductive substrate; said process consisting of applying, to the said substrate, a solution comprising a non-aqueous solution of one or more metal acetylacetonates dissolved in a one or more solvents which specifically dissolve said one or more metal acetylacetonates, the one or more solvents being selected from the group consisting of alcohols, ketones, chloromethanes and mixtures thereof and then converting said one or more metal acetylacetonates to at least one metal oxide by means of a heat treatment; wherein the electrically conductive substrate is made of steel or of iron and is pretreated, in a first stage, and then in a second stage, said non-aqueous solution of one or more metal acetylacetonates dissolved in a one or more solvents is deposited on said pretreated substrate and the substrate thus coated is dried and then calcined under air or an inert gas enriched with oxygen, at a temperature at least equal to 300° C., for a period of time ranging from 10 minutes to 2 hours.

2. Process according to claim 1, characterized in that the alcohol is selected from the group consisting of ethanol and isopropanol.

3. Process according to claim 1, characterized in that the ketone is acetone.

4. Process according to claim 1, characterized in that the chloromethane is chloroform.

5. Process according to claim 1, characterized in that the metal acetylacetonate solution is obtained by dissolution of the said metal acetylacetonate in one or more specific solvents or in a mixture of solvents.

6. Process according to claim 1, characterized in that said solution of one or more metal acetylacetonates is obtained by dissolution of the said one or more metal acetylacetonates in a mixture of said one or more solvents.

7. Process according to claim 1, characterized in that the second stage is repeated at least once.

8. Process according to claim 1 characterized in that said solution comprising several metal acetylacetonates is obtained by mixing solutions comprising a single metal acetylacetonate which is obtained by dissolution of the said metal acetylacetonate in a specific solvent or in a mixture thereof.

9. Process according to claim 1, characterized in that the substrate coated by the one or more metal acetylacetonates is calcined under air or an inert gas enriched with oxygen, at a temperature of between 400° C. and 600° C., for a period of time ranging from 10 minutes to 2 hours.

10. Process according to claim 1, characterized in that the second stage is repeated between 2 and 6 times.

11. Process according to claim 1, characterized in that the precious metal from Group VIII of the Periodic Table of the elements is selected from the group consisting of ruthenium, rhodium, palladium, osmium, iridium and platinum.

12. Process according to claim 11, characterized in that the precious metal is selected from the group consisting of ruthenium and iridium.

13. Process according to claim 12, characterized in that the precious metal is ruthenium.

14. Process for the formation of a coating of metal oxides comprising at least one precious metal from Group VIII of the Periodic Table of the elements in combination with titanium, zirconium or mixtures thereof, on an electrically conductive substrate; said process consisting of applying, to the said substrate, a solution comprising at least one organometallic compound and then converting said at least one organometallic compound to at least one metal oxide by means of a heat treatment; wherein the electrically conductive substrate is made of steel or of iron and the sole solution applied to the said substrate is a non-aqueous solution of one or more metal acetylacetonates dissolved in a one or more solvents which specifically dissolve said one or more metal acetylacetonates, the one or more solvents being selected from the group consisting of alcohols, ketones, chloromethanes and mixtures thereof and wherein said substrate coated by the one or more metal acetylacetonates is calcined under air or an inert gas enriched with oxygen, at a temperature at least equal to 300° C., for a period of time ranging from 10 minutes to 2 hours.

* * * * *